US007878241B2

(12) United States Patent
Buytaert et al.

(10) Patent No.: US 7,878,241 B2
(45) Date of Patent: Feb. 1, 2011

(54) EXPANDABLE CENTRALIZER FOR EXPANDABLE PIPE STRING

(75) Inventors: Jean Buytaert, Mineral Wells, TX (US); Eugene Edward Miller, Weatherford, TX (US); Donald Elwin McDowell, Millsap, TX (US)

(73) Assignee: Frank's International, Inc., Houston, TX (US)

( * ) Notice: Subject to any disclaimer, the term of this patent is extended or adjusted under 35 U.S.C. 154(b) by 302 days.

(21) Appl. No.: 12/042,989

(22) Filed: Mar. 5, 2008

(65) Prior Publication Data

US 2008/0283253 A1 Nov. 20, 2008

Related U.S. Application Data

(63) Continuation-in-part of application No. 11/749,544, filed on May 16, 2007, and a continuation-in-part of application No. 11/828,943, filed on Jul. 26, 2007.

(51) Int. Cl.
*E21B 17/10* (2006.01)

(52) U.S. Cl. ..... 166/241.6; 175/325.5

(58) Field of Classification Search ..... 166/241.6, 166/241.7; 175/325.5, 325.6
See application file for complete search history.

(56) References Cited

U.S. PATENT DOCUMENTS

| | | | | |
|---|---|---|---|---|
| 2,312,600 | A | 3/1943 | Steps | |
| 2,718,266 | A | 9/1955 | Berry et al. | |
| 3,055,432 | A * | 9/1962 | Park | 166/241.7 |
| 3,124,196 | A | 3/1964 | Solum | |
| 3,200,884 | A | 8/1965 | Solum et al. | |
| 3,356,147 | A | 12/1967 | Dreyfuss | |
| 3,566,965 | A | 3/1971 | Solum | |
| 4,021,083 | A * | 5/1977 | Anderson | 175/325.6 |

(Continued)

FOREIGN PATENT DOCUMENTS

| | | |
|---|---|---|
| GB | 2148985 | 6/1985 |

(Continued)

OTHER PUBLICATIONS

PCT/US2008/063097 International Search Report and Written Opinion, dated Sep. 9, 2008, 14 pages.

(Continued)

*Primary Examiner*—Daniel P Stephenson
(74) *Attorney, Agent, or Firm*—Patrick K. Steele; Streets & Steele

(57) ABSTRACT

A close-tolerance expandable bow spring centralizer 8 having a first expandable collar 10A coupled to and spaced apart from a second expandable collar 10B through a plurality of bow springs 30 wherein expandable collars 10A, 10B comprise a plurality of slidably coupled links 16 that separate to expand the diameter of the collars 10A, 10B, e.g., upon expansion of an expandable pipe string 80 on which the centralizer 8 is received. Expandable bow spring centralizer 8 may grip the expandable pipe string 80 when in the collapsed configuration to eliminate the need for a stop collar. Additionally or alternatively, a fin 32 may be connected to each bow spring 30, and then connected to one or more adjacent fins 32 upon collapse of the bow springs 30 to form a restraining band 39 that may be ruptured, e.g., upon expansion of the expandable pipe string 80.

37 Claims, 8 Drawing Sheets

U.S. PATENT DOCUMENTS

| | | | | |
|---|---|---|---|---|
| 4,269,269 | A | 5/1981 | Wilson | |
| 4,328,839 | A | 5/1982 | Lyons et al. | |
| 4,545,436 | A | 10/1985 | Harrison | |
| 4,641,776 | A | 2/1987 | Vlasek et al. | |
| 4,651,823 | A | 3/1987 | Spikes | |
| 4,688,636 | A | 8/1987 | Hennessey | |
| 4,787,458 | A | 11/1988 | Langer | |
| 4,909,322 | A * | 3/1990 | Patterson et al. | 166/241.7 |
| 5,238,062 | A | 8/1993 | Reinholdt | |
| 5,261,488 | A | 11/1993 | Gullet et al. | |
| 5,575,333 | A | 11/1996 | Lirette et al. | |
| 5,908,072 | A | 6/1999 | Hawkins | |
| 6,457,519 | B1 | 10/2002 | Buytaert | |
| 6,484,803 | B1 | 11/2002 | Gremillion | |
| 6,679,325 | B2 | 1/2004 | Buytaert | |
| 6,725,939 | B2 | 4/2004 | Richard | |
| 6,871,706 | B2 | 3/2005 | Hennessey | |
| 6,997,254 | B2 | 2/2006 | Jenner | |
| 7,096,939 | B2 | 8/2006 | Kirk et al. | |
| 7,143,848 | B2 | 12/2006 | Armell | |
| 2002/0139537 | A1 | 10/2002 | Young et al. | |
| 2002/0139538 | A1 | 10/2002 | Young et al. | |
| 2003/0000607 | A1 | 1/2003 | Jenner | |
| 2008/0115972 | A1 | 5/2008 | Lynde et al. | |

FOREIGN PATENT DOCUMENTS

| | | | |
|---|---|---|---|
| GB | 2148985 | A | 6/1985 |
| GB | 2403238 | A | 12/2004 |
| WO | WO 9108374 | | 6/1991 |
| WO | WO9964714 | A | 12/1999 |
| WO | WO2005107395 | | 11/2005 |

OTHER PUBLICATIONS

PCT/US2008/068891 International Search Report and Written Opinion, dated Sep. 29, 2008, 11 pages.
PCT/US2008/063163 International Search Report and Written Opinion, dated Nov. 28, 2008, 19 pages.
PCT/US2008/063163 International Search Report, dated Nov. 9, 2008., 6 pages.
Focus on New Technology; Fall 2007; 1 page.
U.S. Appl. No. 11/749,544, Low Clearance Centralizer and Method of Making Centralizer, filed May 16, 2007.
U.S. Appl. No. 11/828,943, Apparatus for and Method of Deploying a Centralizer Installed on an Expandable Casing String, filed Jul. 26, 2007.
U.S. Appl. No. 12/569,811, filed Sep. 29, 2009, 56 pages.

* cited by examiner

EXPANDABLE CENTRALIZER FOR EXPANDABLE PIPE STRING

STATEMENT OF RELATED APPLICATIONS

The present application is a continuation-in-part application depending from U.S. application Ser. No. 11/749,544 filed on May 16, 2007 by applicants Jean Buytaert, et al. for a Low-Clearance Centralizer and Method of Making Centralizer. The present application is also a continuation-in-part application depending from U.S. application Ser. No. 11/828,943 filed on Jul. 26, 2007 by applicants Jean Buytaert, et al. for an Apparatus and Method for Deploying a Centralizer Installed on an Expandable Casing String. Both of these applications are assigned to the assignee of the present invention.

BACKGROUND OF THE INVENTION

1. Field of the Invention

In one embodiment, the invention relates to a close-tolerance expandable centralizer to dispose an expandable pipe string to a desired position within a borehole. One embodiment of the invention is directed to an apparatus and a method to deploy an expandable centralizer, after it is received on an expandable pipe string and run into a borehole, to generally dispose the expanded pipe string to a desired position within the borehole.

2. Background of the Related Art

Centralizers are commonly secured at spaced intervals along a pipe string to provide radial stand-off of the pipe string from the interior wall of a borehole in which the pipe string is subsequently installed. The term "pipe string," as used herein, may refer to a casing string, a drill string, or any other tubular. A centralizer generally comprises a pair of generally aligned and spaced-apart collars defining a bore therethrough for receiving the pipe string, and a plurality of angularly-spaced ribs that project radially outwardly from the pipe string to provide the desired stand-off from the interior wall of the borehole.

A centralizer can center the pipe string within the borehole to provide a generally uniform annulus between the exterior surface of the pipe string and the wall of the borehole. The centering of the pipe string within the borehole can promote uniform and continuous distribution of cement slurry within the annulus during cementing of the pipe string within a targeted interval of the borehole. Uniform cement slurry distribution can result in a cement liner that better reinforces the pipe string, isolates the pipe string from corrosive formation fluids, and prevents unwanted fluid flow between penetrated geologic formations.

A bow spring centralizer employs flexible bow springs to provide variable stand-off from the borehole. Bow spring centralizers can include a pair of axially-spaced and generally aligned collars coupled one to the other by a plurality of bow springs. The flexible bow springs can be biased toward a deployed configuration to bow radially outwardly and away from the axis of the bore through the centralizer to engage the wall of the borehole and can center a pipe string received through the bores of the collars. Configured in this manner, the bow springs provide stand-off from the wall of the borehole, and flex or collapse radially inwardly to accommodate restrictions and/or irregularities in the wall of the borehole. The bow springs may fully collapse to lie generally flat along a portion of the pipe string to facilitate installation of the centralizer into the borehole through the bore of a previously installed or cemented pipe string, for example.

An expandable pipe string may be formed and positioned within an interval of the drilled borehole, and then expanded within the borehole to a larger diameter. A pipe expansion device, such as, but not limited to, a mandrel or rotary expander tool, may be inserted into the bore of the pipe string and forced through the bore to expand the pipe string. Expansion of pipe strings can enable increased capacity of the pipe string to produce reserves, or to accommodate downhole tools. Generally centering an expanded pipe string can provide a uniform annulus around the expanded pipe string in order to obtain a favorable cement liner during the cementing step, but conventional expandable centralizers are likely to be damaged or impaired due to deformation of the conventional centralizer end collars. Expansion of conventional end collars generally causes substantial plastic deformation of the collar material which may result in instability at the collar and bow spring connection. Any restoring force of the bow spring when released to its deployed configuration may impart a substantial twisting force to the compromised collar and bow spring connection that may force the bow spring to twist out of alignment with the collars and the pipe string.

FIG. 1 is a perspective view of a conventional expandable bow spring centralizer 100 received on a pipe string 80 having a diameter D1. The conventional bow spring centralizer 100 has a plurality of angularly distributed bow springs 120, each secured in a generally aligned relationship with the pipe string 80 by the collar and bow spring connections 116 on the pair of conventional end collars 110A, 110B. The conventional centralizer shown in FIG. 1 may be compromised upon expansion, for example due to plastic deformation at the collar and bow spring connections 116.

FIG. 2 is the perspective view of the expanded conventional bow spring centralizer 100' of FIG. 1 after expansion of the pipe string 80 and the centralizer to an expanded diameter D2. FIG. 2 depicts one embodiment of the substantial plastic deformation that may occur throughout the expanded end collars 110A, 110B, including at the critical collar and bow spring connections 116 on each of the two conventional end collars 110A', 110B' of the expanded centralizer 100'. While the plastically deformed collar and bow spring connections 116' on the centralizer of FIGS. 1 and 2 are shown to be welded, it should be understood that plastic deformation at the collar and bow spring connections may be equally or more compromising where a collar and bow spring connection comprises a fastener and/or a slot and tongue connection because of the stress concentration effects of a hole for receiving a fastener and a slot for receiving a tongue. Similarly, a heat affected zone (HAZ) of a welded connection may contribute to instability resulting from expansion of the conventional collar and bow spring connection.

The need to minimize the thickness of the end collar imposes a significant limitation on the design of the centralizer. The thickness of the centralizer collars prior to expansion within the borehole limits the diameter of the expandable pipe string that can be installed in the borehole through a restriction. Close-tolerance centralizers generally have fully collapsible bow springs and thin-profile end collars. Conventional close-tolerance centralizer end collars may be easily impaired by expansion due to the need to make the collar radially thin enough to fit within a narrow annulus between the expandable pipe string on which the centralizer is received and a restriction, such as, for example, a previously installed pipe string through which the centralizer and the expandable pipe string must pass for installation in a borehole. However, a thin conventional end collar is more susceptible to failure due to expansion, especially at the collar and bow spring connections, due to plastic deformation.

Another challenge associated with expandable bow spring centralizers is related to the need to restrain the bow springs in their collapsed configuration to facilitate installation of the expandable pipe string into the borehole through a restriction, e.g., the bore of a previously installed pipe string, and to the need to deploy the expandable bow spring centralizer within the targeted interval of the borehole to center the expanded pipe string. One method that has been proposed involves the steps of restraining the bow springs of a centralizer in their collapsed configuration using a restraining band of a selected material, and then by corrosively compromising the restraining band with an acid introduced into the borehole after the expandable centralizer and the pipe string on which it is installed are placed in the borehole. Another method that has been proposed involves using downhole actuators, such as hydraulic pistons activated from the surface, to deploy the bow springs when the centralizer and the pipe string are positioned in the targeted interval of the borehole. Still another method, taught in U.S. application Ser. No. 11/828,943 filed on Jul. 26, 2007, involves the use of a prefabricated sacrificial restraining band to restrain the bow springs in their collapsed configuration. The prefabricated band ruptures upon expansion of both the expandable pipe string and the centralizer within the targeted interval of the borehole.

These methods require expensive or complex systems that introduce other problems. For example, an acid that can dissolve the restraining band that restrains the bow springs in their collapsed configuration can be expensive to make and difficult to transport to the well, difficult to place in the borehole at the targeted interval, and it may damage or impair other articles or materials in the borehole that will be exposed to the acid. Similarly, a hydraulic actuator used to deploy the bow springs may add considerable cost and weight to a centralizer, it may consume already limited radial space and thereby limit the size of the expandable pipe string being installed, and additional systems are required to power the hydraulics. Also, in an external restraining band embodiment, the outer diameter of the end collars that connect to and stabilize the bow springs imposes a minimum diameter of a prefabricated restraining band that can be received over the end collars and then positioned on the bow springs to hold them in their collapsed configuration. This limitation on the diameter of a prefabricated restraining band imposed by the outer diameter of the end collars may prevent the bow springs from being restrained in a fully collapsed configuration. As a result, the outer diameter of the collapsed bow springs is greater than it should be, thereby increasing the running and starting forces encountered during installation of the pipe string in the borehole.

What is needed is an expandable bow spring centralizer with close-tolerance expandable collars that expand with substantially reduced plastic deformation of the material at the collar and bow spring connections. What is needed is an expandable close-tolerance bow spring centralizer collar that maintains stable collar/bow spring connections after expansion of a pipe string on which the centralizer is received. What is needed is an expandable centralizer comprising close-tolerance expandable collars that are adapted to expand in diameter primarily through sliding rather than primarily through plastic deformation. What is needed is an expandable bow spring centralizer with bow springs that can be collapsed and restrained in the fully collapsed configuration by one or more restraining bands, and deployed to an expanded configuration by sacrificial failure of the band upon expansion of a pipe string upon which the centralizer is received. What is needed is an expandable centralizer that is adapted to be collapsed and restrained in its collapsed configuration using structures that introduce no unwanted materials into the borehole. What is needed is a restraining band to restrain the bow springs of a centralizer in their collapsed configurations that can be of a diameter that is smaller than the end collar of the centralizer.

BRIEF DESCRIPTION OF THE DRAWINGS

FIG. 2 shows the substantial plastic deformation that may occur at the collar and bow spring connections on the two conventional expandable collars of the expandable centralizer.

SUMMARY OF THE INVENTION

Figure 1:
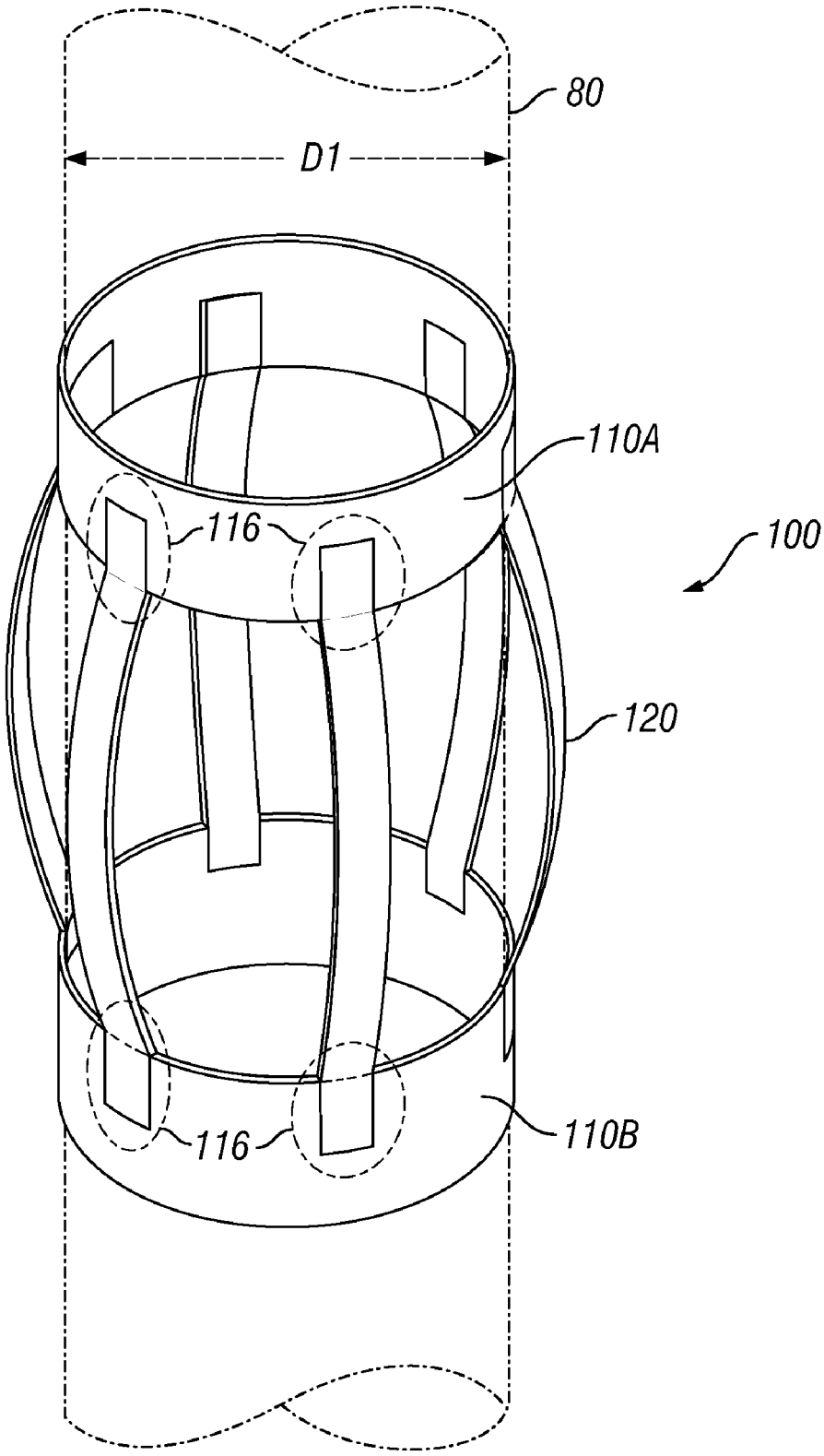
FIG. 1 is a perspective view of a conventional expandable bow spring centralizer with conventional expandable collars and collar and bow spring connections that may be compromised as a result of plastic deformation.
Figure 2:
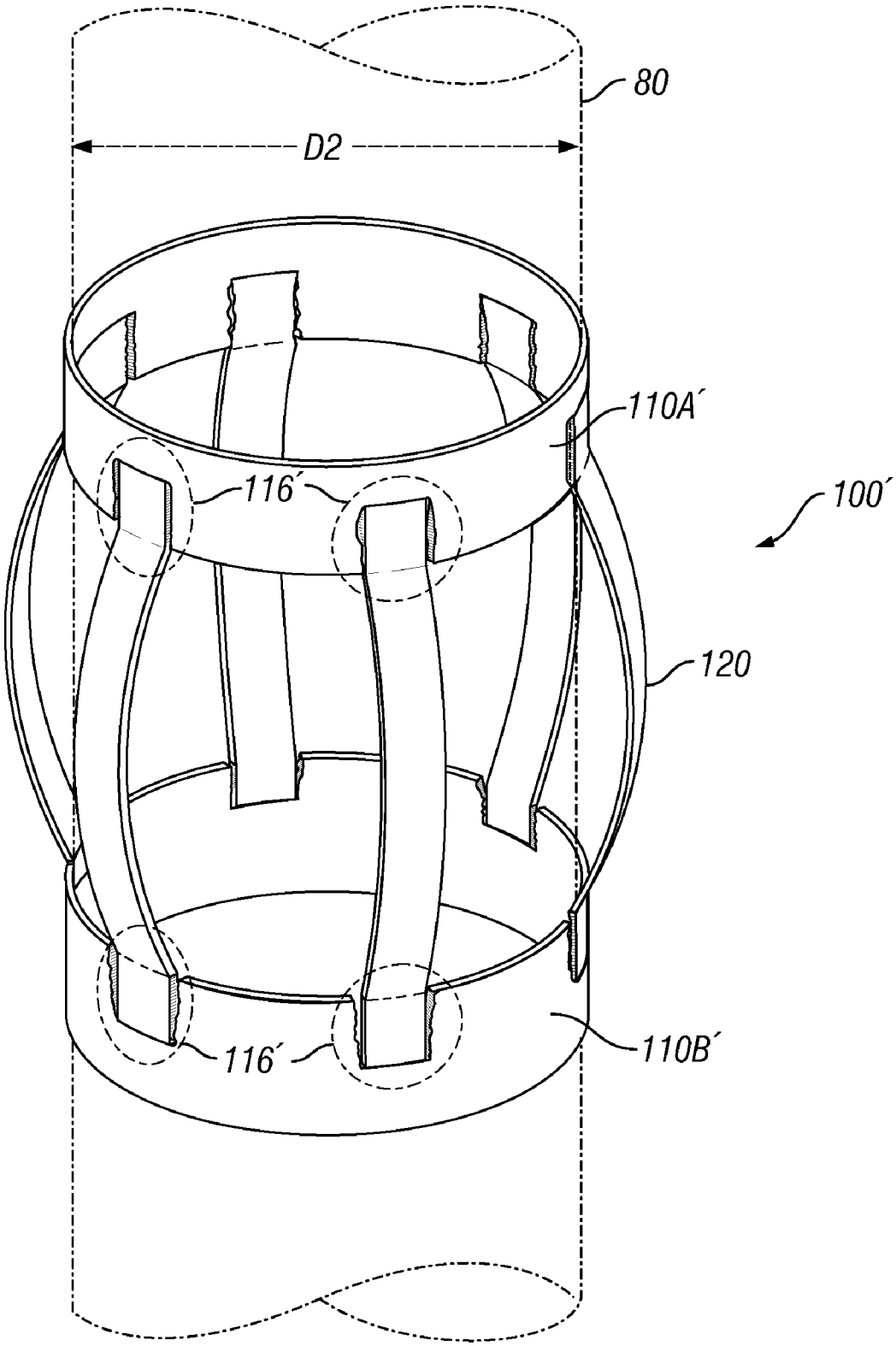
FIG. 2 is the perspective view of the conventional expandable bow spring centralizer of FIG. 1 after expansion of the pipe string and the expandable centralizer.

Embodiments of the apparatus and/or the method of the invention satisfy one or more of these needs. One embodiment of the apparatus is an improved close-tolerance expandable centralizer to generally center an expandable pipe string within an interval of a drilled borehole. The close-tolerance expandable centralizer may comprise a first expandable collar generally aligned with and spaced-apart from a second expandable collar, the first expandable collar coupled to the second expandable collar by a plurality of bow springs. A number of the close-tolerance expandable centralizers may be installed on an expandable pipe string made up and run into the borehole at the surface, and the expandable pipe string may be installed in a targeted interval of the borehole. The bow springs of the expandable centralizer may be collapsed to lie generally flat along the portion of the pipe string between the first expandable collar and the second expandable collar, and the bow springs may be restrained in the fully collapsed configuration using one or more restraining bands to facilitate installation of the expandable pipe string in a targeted interval of the borehole. In one embodiment, the one or more restraining bands may be fabricated in place by coupling band segments or fins connected to a plurality of bow springs, as opposed to prefabricated and fitted over an end collar, in order to customize the restraining band(s) to restrain the bow springs in the fully collapsed configuration and to thereby minimize the overall diameter of the collapsed centralizer. It should be understood that, while the fabrication in place of a band by coupling band segments or fins connected to a plurality of bow springs may reduce the overall diameter of the collapsed centralizer, the expandable centralizer collars may be employed with or without fabrication in place of a band by coupling band segments.

In one embodiment, the curvature of each bow spring changes along the length of the bow spring from a minimum curvature adjacent to the first end and the second end of the bow spring, to a maximum curvature near the center of the bow spring generally intermediate the first end and the second end. This embodiment may provide an expandable centralizer that is self-securing when the bow springs are collapsed to lie generally along a portion of the length of the pipe string on which the expandable centralizer is received. This self-securing capacity is due to the inwardly-directed gripping action by the portions of each bow spring immediately adjacent to its first end and to its second end as the bow spring is radially inwardly collapsed. It should be understood that the amount of grip imparted by the bow springs to the exterior of the expandable pipe as the bow springs are collapsed to lie along a portion of length of the pipe string may be determined by, among other factors, the shape of the bow springs, and specifically by the contour of the bow springs immediately adjacent to the bow spring/collar connections. In these portions, the curvature of each bow spring may be generally opposite in direction to the curvature of the middle portion of each bow spring that deploys to engage the wall of the borehole. The grip applied to the exterior surface of the expandable pipe string by the collapsed bow springs, coupled with the application or fabrication of a band to restrain the bow springs in the collapsed configuration prior to installation of the expandable pipe string into the borehole, eliminates the need for one or more stop collars to secure the expandable centralizer in its axial position on the expandable pipe string. The collapsed bow springs continue to grip the exterior of the expandable pipe string until the bow springs of the expandable centralizer are deployed. Upon deployment, the centralizer may be secured in place within the borehole by the gripping force applied by the portions of the bow springs that engage the wall of the borehole.

In one embodiment, each of the first and the second close-tolerance expandable collars may each comprise a plurality of links, each link slidably coupled to two adjacent links to form a generally cylindrical collar. Each link may comprise a first side, a second side generally opposite the first, and a bow spring connection where the link may be connected to either the first end or the second end of a bow spring. Each link may further comprise an extension protruding outwardly from the first side, which may terminate in a head, a chamber within the interior of the link for receiving the head, and a channel for receiving the extension and having a first end at the chamber and a second end at the second side of the link. The bow spring connection may be positioned on the link generally intermediate the first side and the second side of the link, and may be above or below the midline of the link defined by a projected line along the protruding extension.

One embodiment of the expandable collar may comprise a plurality of such links, each slidably coupled to two adjacent links by slidably receiving the extension and the head of a first link within the channel and the chamber, respectively, of an adjacent link to form a pair of links that are movably coupled one to the other. It should be understood that the movable coupling of each adjacent pair of links may have a limited range of slidable separation of one link from an adjacent coupled link. The range of separation may be determined by the size of the head extending from a link, and by the size of the chamber of the adjacent link in which the head is slidably received. The head of a first link may, for example, start at a distal end of the chamber of an adjacent, second link and, upon expansion of the expandable pipe string and the expandable centralizer, the head of the first link may slide towards the proximal end of the chamber as the second link separates from the first link from which the head extends. When the head extending from the first link moves to and engages the proximal end of the chamber of the second link, the separation of the second link from the first link terminates, and any further expansion of the expandable centralizer collar must occur as a result of separation of one or more other pairs of adjacent links.

It should further be understood that, in one embodiment, the expandable collars of the expandable centralizer may be made so that each collar is secured in its position on the expanded pipe string. For example, but not by way of limitation, an expandable collar in which each slidably extendable pair of adjacent links has separated one from the other in a manner to cause the head of each link to move to its extreme position at the proximal end of the chamber of the adjacent link in which the head is movable, may thereby form an expanded collar imparting a grip on the exterior of the expanded pipe string. This grip by each of the slidably expanded collars of the centralizer may be achieved by, for example, making the dimensions of the head, extensions, chambers and links so that the cumulative slidable expansions of each slidably coupled pair of links approximately equals the increase in the circumference of the expanded pipe string over and above the circumference of the unexpanded pipe string. An expandable centralizer made according to this embodiment of the method may self-secure in its position on the expanded pipe string without the need for one or more stop collars to maintain its position.

While each of the links may have an identical shape and size, it should be understood that alternate embodiments may include the use of alternate links of a dissimilar shape and form. For example, but not by way of limitation, every other link may comprise two opposing extensions, each terminating in a head, and each link between the links having two opposed extensions may comprise two opposed channels, one for slidably receiving an extension from a first link on a first side and one for slidably receiving a second link on a second side. This mere variation may be adapted to achieve the same slidably adjustable relationship between adjacent links, and is within the scope of the invention.

In one embodiment, a planar projection of the head on the extension of a link may be generally rectangular and the chamber of the adjacent link within which the head may be slidably received may similarly be generally rectangular, but more elongated in the circumferential direction. One such embodiment is illustrated in the drawings appended to this application and is described in more detail below. In other embodiments, a planar projection of the head may be generally triangular so that the extension and the head together appear to be arrow-shaped, and the chamber of the adjacent link within which the head is slidably received may also be generally arrow-shaped, but elongated at its intersection with the channel to accommodate sliding movement of the head within the chamber. In yet another embodiment, a planar projection of the head may be generally bulbous or tear drop-shaped, and the chamber of the adjacent link within which the head is slidably received may be of a generally corresponding bulbous shape, but elongate to accommodate sliding movement of the head within the chamber upon movement of the link to which the head is connected relative to the link within which the chamber that receives the head resides.

It should be understood that each of the elements of the link, including, but not limited to the extension, the head, the chamber and the channel, may be curved or arcuate in the circumferential direction so that the plurality of links coupled together generally conform to the shape of a tube to minimize the clearance required to accommodate the expandable collar and the size of the annulus within which the expandable centralizer may be disposed when the bow springs are collapsed and restrained in their collapsed configuration.

Embodiments of the expandable centralizer permit expansion of the expandable centralizer, along with the pipe string on which the expandable centralizer is received, to a larger diameter without substantial plastic deformation at the collar and bow spring connections on each link. Plastic deformation of the collar and bow spring connections is substantially reduced or eliminated by embodiments of the expandable centralizer that provide for limited separation of adjacent links to accommodate expansion of the pipe string on which the expandable centralizer is received without compromising the integrity and stability of the collar and bow spring connections. As the pipe string expands, each of the slidably coupled links may separate from the two adjacent links to increase the diameter of the expandable collars with substantially reduced plastic deformation of the collar and bow spring connections on the links. Reduction or elimination of plastic deformation at the collar and bow spring connections maintains stable and twist-resistant collar and bow spring connections and ensures reliable deployment of the bow springs after expansion of the pipe string to better center the pipe string within the targeted interval of the borehole.

In one embodiment, the collar and bow spring connection on each link may be integrally formed with the link. For example, but not by way of limitation, the centralizer may be cut using a laser from a unitary piece of tubular pipe in accordance with the methods disclosed in U.S. Utility patent application Ser. No. 11/749,544 filed on May 16, 2007 by applicants Jean Buytaert, et al. and assigned to the assignee of the present invention. In another embodiment, the collar and bow spring connections may each comprise a welded connection, a fastened connection, which may include a screw, bolt and nut, etc., or a slot and tongue connection wherein a "dogleg" or offset portion near the end of the bow spring is received through a slot in the collar. The stress concentration elements that may be introduced by these connections are not as potentially destabilizing to the connection due to the lack of substantial plastic deformation.

In one embodiment, adjacent links of each expandable collar may be slidably coupled one to the others, but also joined one to the others using one or more sacrificial link connections. The sacrificial connection may restrain the links against movement relative to adjacent links until the expandable centralizer is expanded. Where the centralizer collar is cut from a unitary piece of tubular pipe, the sacrificial link connections may comprise small "bridges" of the original material consisting of one or more interruptions in the cut between adjacent links. Alternately, these sacrificial connections may comprise spot welds or bonding agents. The use of the sacrificial link connections to restrain the expandable collar in its original, unexpanded condition facilitates handling, shipping and installation of the centralizer on the pipe string.

An integral collar and bow spring connection formed in accordance with the method taught in the above-cited Buytaert et al. application may provide an advantageously low-clearance connection that is strong, and that consumes minimal radial space so that the expandable centralizer bow springs may be collapsed and disposed within a narrow annulus between the exterior of a pipe string on which the expandable centralizer is received and a restriction, e.g., the bore of a previously installed pipe string. Alternately, a welded connection may be formed in a manner that also consumes little radial space. For example, but not by way of limitation, a coupon approximately the width of the first end of a bow spring may be cut from each link of the expandable centralizer collar to form a recess therein, and the first end of a bow spring may be disposed within the recess and welded to the link along the sides and along the bottom of the recess. The welded seam may then be dressed using a grinder, and the resulting collar and bow spring connection may be strong enough to later resist twisting of the deployed bow spring relative to the collar, and thin enough to fit within a narrow annulus formed between two pipe strings.

In an alternate embodiment, the expandable centralizer may be adapted to be restrained in its collapsed configuration using one or more restraining bands formed by connecting a plurality of bow spring fins to form a sacrificial restraining band. More specifically, one or more bow spring fins, each of which may comprise a band segment, may be coupled to each bow spring of the expandable centralizer at a position that is generally adjacent to bow spring fins that are connected to the adjacent bow springs. The fins may protrude in a generally circumferential direction (i.e., generally perpendicular to the radial direction) from the bow spring so that they each contact and/or overlap the end one or more adjacent fins protruding from an adjacent bow spring when the bow springs are disposed to their collapsed configuration using a collapsing tool. A restraining band formed in this manner may be of a smaller diameter than the diameter of the end collars that are connected to and stabilize the bow springs. In one alternate embodiment, the fins may not touch and overlap, but may instead be brought into close proximity to a fin protruding from the adjacent bow spring to form a small gap there between. Adjacent fins, either touching or in close proximity, may be joined, for example, by spot welding, or otherwise connected to form a restraining band to restrain the collapsed bow springs in their collapsed configuration upon removal of the collapsing tool. The restraining band is adapted to sacrificially fail at the spot welded connections that connect adjacent pairs of fins upon expansion of the expandable centralizer and the expandable pipe string on which the expandable centralizer is received.

In one embodiment, each fin protrudes from the side of the bow springs so that the fin, which is substantially thinner than the radial thickness of the bow spring, does not increase or contribute to the overall outside diameter of the bow springs of the centralizer when the bow springs are collapsed. In an alternate embodiment, each fin may be connected to the radially inwardly disposed surface of a bow spring so that the thin fins, when connected to form a restraining band, do not interrupt the smooth outer surfaces of the bow springs. The connected fins form a thin restraining band that holds the bow springs from within, thereby adding very little or no extra outside diameter at the bow springs.

So that the manner in which the above recited features of the present invention can be understood in detail, a more particular description of the invention, briefly summarized above, may be had by reference to embodiments, some of which are illustrated in the appended drawings. However, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 3:
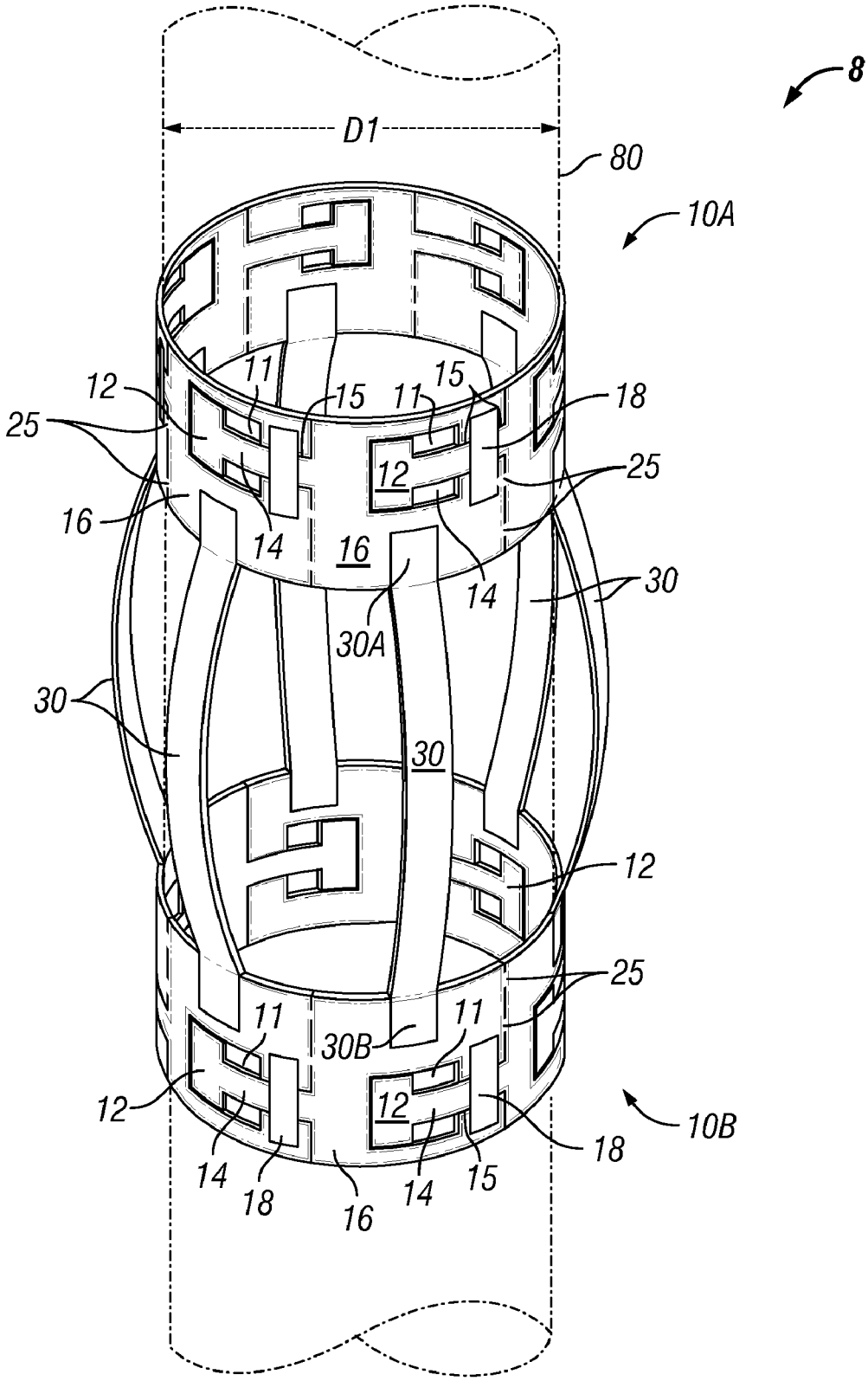
FIG. 3 is a perspective view of one embodiment of the improved close-tolerance expandable centralizer having a first expandable collar connected to the first end of each of a plurality of bow springs, and a second expandable collar connected to the second end of each of the plurality of bow springs.

FIG. 3 illustrates one embodiment of an expandable centralizer 8 comprising a pair of opposed, expandable end collars 10A, 10B (hereinafter "expandable collars") and a plurality of generally angularly distributed bow springs 30. The expandable collars 10A, 10B each have a bore, and the bores of the two expandable collars are generally aligned, one with the other, to receive a generally linear and expandable pipe segment 80 there through.

The illustrated bow springs 30 each have a first end 30A connected to the first expandable collar 10A, and a second end 30B connected to the second expandable collar 10B. Each bow spring 30 is shown in FIG. 3 in its deployed and outwardly bowed configuration, and each is generally flexible and collapsible to lie generally along a portion of the exterior surface of the pipe segment 80 that may be received through the aligned bores of the expandable collars 10A, 10B. When collapsed, e.g., to lie along the exterior of the pipe segment 80, each bow spring 30 exerts a substantial restoring force that urges the bow spring to its deployed configuration shown in FIG. 3 unless restrained in its collapsed configuration.

Expandable collar 10A comprises a plurality of links 16, each having a collar and bow spring connection joining the link 16 to the first end 30A of a bow spring 30. Similarly, opposing expandable collar 10B comprises a plurality of links 16, each having a bow spring connection joining the link 16 to the second end 30B of a bow spring 30. Each link 16 of depicted expandable collars 10A, 10B is connected to either the first end 30A or to the second end 30B of a bow spring 30, and each link 16 is slidably coupled to two adjacent links 16 by an extension 14 received through a channel 15 and terminating in a head 12 that is received within a chamber 11. For example, each link 16 of the first expandable collar 10A shown in FIG. 3 comprises an extension 14 protruding from the left side of each link 16, and a chamber 11 formed within the link at an interior end of a channel 15 that extends from the chamber 11 to the right side of the link 16. Each link 16 of the first expandable collar 10A further comprises a collar and bow spring connection to the first end 30A of a bow spring 30, the connection being generally intermediate the left side and the right side of each link 16, and generally below the midline of each link 16 defined by a projected line extending through the extensions 14 that protrudes from the left side of each of the links 16.

In the embodiment of the expandable centralizer shown in FIG. 3, the second expandable collar 10B is comprised of a plurality of links 16 that are horizontally similar to, but vertically reversed from, the links 16 that make up the first expandable collar 10A. In the second expandable collar 10B, each extension 14 of each link 16 also extends from the left side of the link 16 (when the link 16 is viewed from outside the collar 10B), and each chamber 11 is formed within the interior of each link 16 at the interior end of a channel 15 that extends from the chamber 11 to the right side of the link 16 (again, when the link 16 is viewed from outside the collar 10B). Unlike the links 16 of the first expandable collar 10A, the collar and bow spring connection of each link 16 of the second expandable collar 10B to the second end 30B of a bow spring 30 is generally above the midline of the link 16, whereas the collar and bow spring connections of each link 16 of the first expandable collar 10A to the first end 30A of a bow spring 30 is generally below the midline of the link 16.

It should be understood that either or both of the expandable collars 10A, 10B of FIG. 3 could be cut using a reversed pattern (as compared to that shown in FIG. 3) so that, for example, each extension 14 of each link 16 might extend from the right side of the link 16 (when the link 16 is viewed from outside the collar 10B), and each chamber 11 is formed within the interior of each link 16 at the interior end of a channel 15 that extends from the chamber 11 to the left side of the link 16 (again, when the link 16 is viewed from outside the collar 10B), with no loss of function of the expandable collar to slidably expand to a larger diameter and circumference by slidable separation of each link from one or both adjacent links by sliding of the extension 14 and head 12 of the link 16 within the channel 15 and the chamber 11, respectively, of an adjacent link 16. Variations in the pattern and structure of the slidably coupled links are within the scope of this invention. For example, the extent to which each link 16 may slidably separate from an adjacent, coupled link may vary based on the geometry of the link including the length of the extension, the position and size of the chamber and the circumferential thickness of the head. Also, the head may comprise various shapes, as discussed below.

In one embodiment, a link may further comprise an elongate keeper 18 coupled at its ends to the exterior surface of the link 16 and extending across the channel 15 of the link 16 to generally contain the extension 14 of an adjacent link 16 within the channel 15 of the link 16, and also to prevent the head 12 on the end of an extension 14 protruding form an adjacent link 16 from being pulled completely from the chamber 11 of the link 16. The keeper 18 may limit the extension of each pair of links 16, and it may be positioned on the link 16 to engage the extension 14 of the adjacent link 16 as it slides within the channel 15 causing the circumferential curvature of the extension 14 to conform to the larger, expanded diameter of the pipe string on which the expandable centralizer is received. The keeper 18 may apply a force to the extension 14 during expansion of the expandable centralizer 8 that flattens the extension toward a less arcuate shape.

In an alternate embodiment, the extension of some of the pairs of links may be limited, and the extension 14 of some links 16 may be flattened by application of an enlarged keeper that covers a substantial portion of the channel 15 and the chamber 11 of some or all of the links 16. For example, but not by limitation, an enlarged keeper may comprise a sheet of thin and generally flexible metal that may be generally equal size to the link 16. The thin sheet metal keeper may be secured in a blanketing configuration onto a link 16, e.g., by spot welding or by use of an adhesive to cover the channel 15 and the chamber 11 of the link 16. The enlarged keeper would serve the same general purposes of the keeper 18 shown in FIGS. 3 and 4, that is, it would contain the extension 14 within the channel 15, limit the extension of each pair of links 16, and flatten the extension 14 during expansion of the expandable collar. In addition, the substantially keeper may deter the accumulation of debris within the channel 15 and chamber 11 that might otherwise interfere with the slidable expansion of the expandable collar. In addition, the enlarged keeper may prevent the expandable collar from hanging up on borehole obstructions, tubular joints and other structures in the borehole during installation of the expandable tubular string into the borehole.

In one embodiment, a laser (e.g., an industrial laser), water jet or other cutting apparatus, may be used to cut the expandable collars 10A, 10B, for example, from a unitary piece of tubular pipe. It should be understood that the thickness and the diameter of the expandable centralizer collars 10A, 10B may vary according to the size of the pipe string to be centered within a borehole and accordingly to other parameters, e.g., those affecting the strength requirements of the expandable centralizer. The thickness and diameter of an expandable centralizer may exceed or fall below these ranges.

It should be understood that the slidably coupled links shown in FIG. 3, for example, may be cut from a unitary piece of pipe by cutting along a pattern, and then by removing coupons of pipe wall material formed during cutting and positioned within the chamber 11 of each link 16, and on opposite sides of the extension 14. For example, in the embodiment of the expandable centralizer 8 shown in FIG. 3, the coupons have been removed, thereby leaving a pair of generally rectangular and variable-sized apertures on either side of each extension 14, the circumferential length of these apertures generally defining the extent to which each pair of adjacent links 16 may separate one from the other by sliding of the head 12 within the chamber 11 of the adjacent link 16. In one embodiment, the expandable collars 10A, 10B of the expandable centralizer 8 are made so that each expanded collar 10A, 10B is self-secured in its position on the expanded pipe string 80. For example, but not by way of limitation, an expandable collar 10A, 10B in which each slidably extendable pair of adjacent links 16 has separated one from the other in a manner to cause the head 12 of a first link 16 to move from its remote position at the distal end of the chamber 11 of the adjacent, second link 16 to its extreme position at the proximal end of the chamber 11 of the adjacent, second link in which the head 12 is movable, may thereby form an expanded collar 10A, 10B that has a residual grip on the exterior of the expanded pipe string 80. This residual grip by each slidably expanded collar 10A, 10B of the expandable centralizer may be achieved by, for example, making the dimensions of the head 12, extensions 14, chambers 11 and links 16 so that the cumulative slidable expansions of each slidably coupled pair of links 16 approximately equals the increase in the circumference of the expanded pipe string 80 as a result of expansion. More specifically, the inside diameter of the expanded collars 10A, 10B of the expandable centralizer 80 may be slightly less than the outside diameter of the expanded pipe string 80 to place the expanded collars 10A, 10B of the expanded centralizer 8 in a tensile condition on the exterior of the expanded pipe string 80. An expandable centralizer 8 made according to this embodiment of the method will self-secure in its position on the expanded pipe string 80 without the need for one or more stop collars to maintain its position.

It should also be understood that the geometric shape of the head and chamber may vary. While the shape of the heads 12 and chambers 11 shown in FIG. 3 are generally rectangular, other embodiments may comprises generally bulbous heads slidably received within correspondingly bulbous, but more elongate, chambers. Other embodiments may comprise generally arrow-shaped heads slidably received within generally arrow-shaped, but more elongate, chambers. There may be numerous variations of shapes that may be applied to the slidably coupled links of the expandable collars 10A, 10B of the expandable centralizer 8 without departing from the spirit of the claimed invention disclosed herein.

It should also be understood that coupons of material can be cut from other locations in the pattern formed by the slidably coupled links. For example, but not by way of limitation, cutting 0.125 inches of material to increase the clearance between the channels 15 and the extensions 14 slidably received therein, and/or between the chambers 11 and heads 12 slidably received therein, to generally enhance the slidable coupling and to decrease unwanted resistance to separation between any pair of adjacent links.

It may be advantageous to restrain the expandable centralizer collars 10A and 10B in their unexpanded configuration to make the expandable centralizer 8 easier to ship, handle and/or install on an expandable pipe string 80. It should also be understood that the use of a laser or water jet, especially one that is positionable using a computer automated manufacturing system, enables the expandable centralizer collars 10A, 10B to be made with one or more small sacrificial bridges 25 of the original material connecting each adjacent pair of links to thereby restrain the links 16 against slidable separation one from the other until the expansion of the expandable pipe string 80 within the expandable centralizer 8 sacrificially ruptures the bridges 25 to separate each pair of links 16 and to expand the expandable collars 10A, 10B. It should be understood that the width of such a bridge 25 of material to connect adjacent links 16 may be determined according to the diameter D1 and/or the thickness of the pipe from which the expandable centralizer 10A, 10B is cut. Each bridge 25 of material between adjacent links 16 can be design selected so as to not cause significant stressing or deformation of the links 16 during expansion of the expandable pipe string 80, and each can be designed to not be so narrow that it may fail prematurely and allow premature expansion by separation of any pair of the links 16 of an expandable collar 10A, 10B during installation or handling. For example, but not by way of limitation, each bridge 25 may be formed by a small discontinuity in the pattern followed using a laser to cut the expandable centralizer from a unitary piece of tubular. The discontinuity may be, for example, about 0.10 inches on a collar having a thickness of about 0.30 inches. It should be understood that the bridges 25 used to couple a pair of adjacent links 16 in the pre-extended condition may be made sufficient to restrain the links 16 one adjacent to the other in the un-extended configuration, but may also be small enough to ensure sacrificial failure of the bridges 25 without unwanted deformation of a link 16 to which the bridge 25 may be connected. Also, each bridge 25 should be made in a manner to ensure sacrificial failure of all bridges 25 and slidable separation of each pair of adjacent links 16 without overextension or damage to any extended pair of adjacent links 16. The bridges 25 should be made small enough so that, in an expansion event wherein full expansion is achieved by sequential slidable separation of adjacent pairs of links 16, no extended pair of links 16 may be pulled during the expansion of the centralizer 8 enough to, for example, rupture the extension 14 coupled to a head 12 of a link that has already moved to its extreme position within a chamber 11 of an adjacent link 16. For this reason, the bridges 25 of material or, alternately, spot welds or other couplings applied to retain each un-extended pair of links 16 one adjacent the other should be selected to ensure sacrificial failure below a threshold level that would otherwise overextend or damage an already slidably extended pair of adjacent links 16. This design parameter will ensure extension of each pair of adjacent links 16 one from the other, full expansion of the expandable collars 10A, 10B about the expanded pipe string 80, and self-securing of the expanded centralizer 8 on the exterior surface of the expanded pipe string 80.

In an alternative embodiment, each link 16 of the expandable collars 10A, 10B may be completely cut and separated from the adjacent links 16 during the manufacturing process, leaving only the slidable coupling there between. Subsequently, each pair of adjacent links 16 may be connected one to the other using, for example, a bonding agent or sacrificial spot welds to restrain the expandable collars in their contracted (pre-expanded) configuration. In one alternative embodiment, adjacent links may be connected using deformably releasable couplings, such as hook and loop fasteners or lapped unions, sacrificial bands, welding, or other methods known in the art. While this alternative method of connected separated links can be used, the sacrificial bridges formed using the method described advantageously eliminates the step of connecting the links 16.

Figure 4:
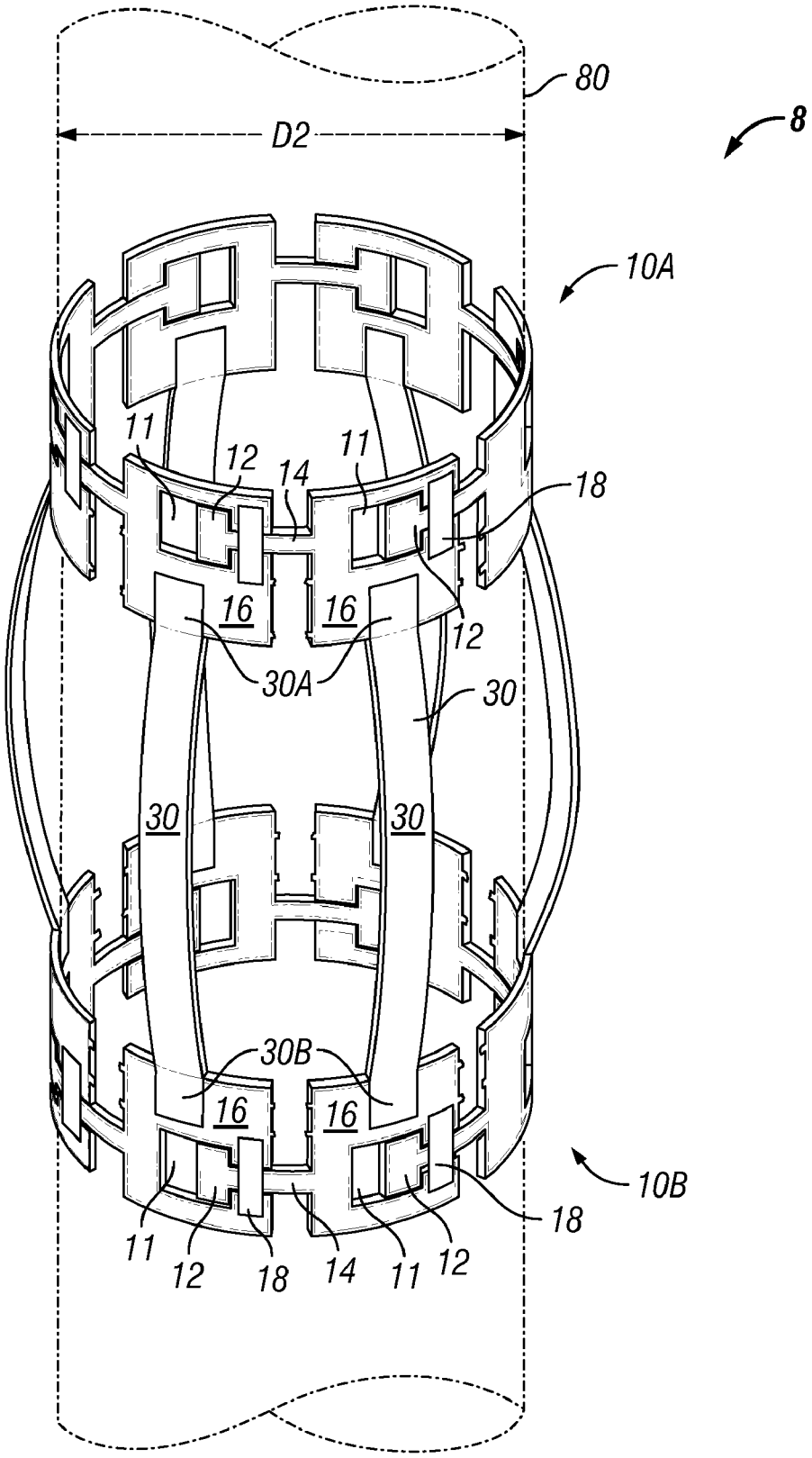
FIG. 4 is the perspective view of the close-tolerance expandable centralizer of FIG. 3 after the expandable collars are slidably expanded without substantial plastic deformation of the collar and bow spring connections.

FIG. 4 is the perspective view of the expandable centralizer of FIG. 3 after the expandable collars 10A, 10B of the expandable centralizer 8 are expanded, for example, without substantial plastic deformation of the collar and bow spring connections. Each extension 14 protruding from each link 16 is shown to be slid within the channel 15 of the adjacent link 16, and each head 12 at the end of each extension 14 protruding from each link 16 is shown to be slid within the chamber 11 of the adjacent link 16 in a corresponding amount of circumferential movement. Each link 16 is shown to be separated from each of the adjacent links 16 by a gap corresponding to the same circumferential distance. As a result, the diameter of the expandable collars 10A, 10B is shown to have increased from D1 (see FIG. 3) to an expanded diameter D2. During sliding movement of each extension 14 of a link 16 within the channel 15 of the adjacent link 16, the keeper 18 has contained the extension 14 within the channel 15 and imposed on the extension 14 a bending force causing the extension 14 to assume a less arcuate shape and to substantially conform to the expanded circumference and curvature of the expanded pipe string 80.

It should be understood that embodiments of the expandable centralizer 8 having alternative shapes of the heads 12, such as arrow-shaped heads or bulbous heads, will function in generally the same manner as the expandable centralizer 8 depicted in FIGS. 3 and 4. It should further be understood that the dimensions of the various structural features of each link 16, including, but not limited to, the width and length of the channels 15, chambers 11, heads 12, extensions 14, bridges 25 or connections to the bow springs 30, and the positioning of these or other structural features on each link 16, may be varied and/or optimized without departing from the spirit of the invention.

Figure 5:
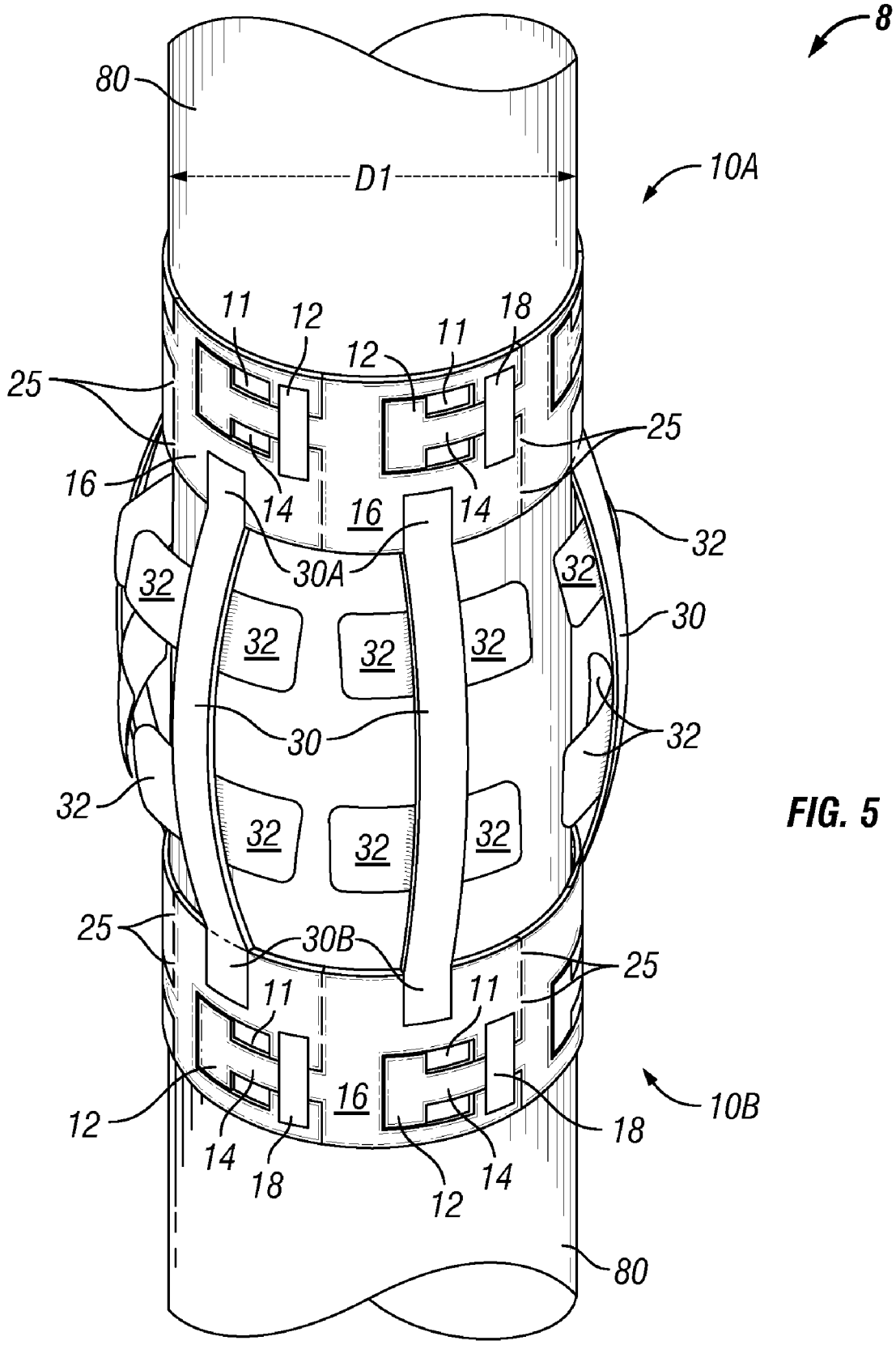
FIG. 5 is a perspective view of another embodiment of the improved close-tolerance expandable centralizer having one or more bow spring fins connected to each bow spring between its first end and its second end, the fins connected to each bow spring to form two generally parallel arrangements of fins, each arrangement generally disposed between two planes that are parallel and generally perpendicular to the axis of a pipe string on which the expandable centralizer may be received.

FIG. 5 is a perspective view of another embodiment of the improved expandable centralizer 8 having one or more fins 32 connected to each of the bow springs 30 between the first end 30A and the second end 30B. The fins 32 shown connected to the bow springs 30 in FIGS. 5-8 to collectively form two generally parallel arrangements of fins 32, each generally between two parallel planes that are perpendicular to the axis of a pipe string 80 on which the expandable centralizer 8 may be received. Each pair of fins 32 disposed on a bow spring 30. Fin 32 may comprise a thin metal band segment that is generally flat and thin relative to the thickness of the bow spring 30 to which it is connected. Each pair of fins 32 are shown in FIG. 5 connected to the radially inwardly disposed side of the bow spring 32, which can abate hanging or snagging of the fins 32 on borehole obstructions or one other articles in the borehole, e.g., during installation of the pipe string 80 and the expandable centralizer 8. The fins 32 may protrude in a generally circumferential direction from each bow spring 30 and/or toward an adjacent bow spring which, as shown in FIG. 5, may support an adjacent fin 32. The fins 32 are generally positioned on the bow springs 30 to bring the fins 32 into close proximity or contact when the bow springs 30 are collapsed, e.g., to lie generally along a portion of the length of the pipe string 80 on which the centralizer 8 received.

Figure 6:
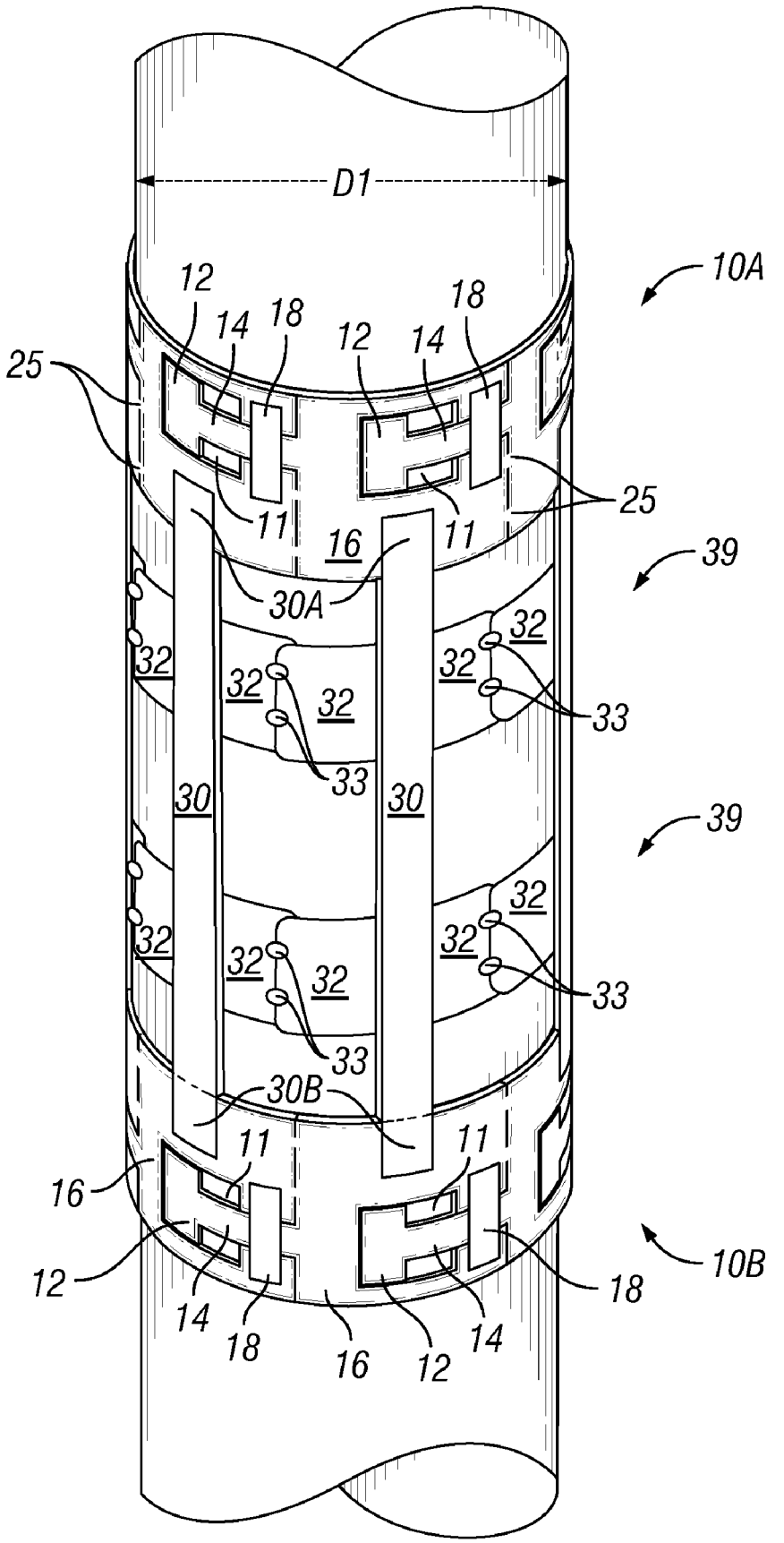
FIG. 6 is a perspective view of the close-tolerance expandable centralizer of FIG. 5 after the bow springs have been collapsed and the bow spring fins have been spot welded to form a pair of generally parallel sacrificial restraining bands.

FIG. 6 is a perspective view of the expandable centralizer 8 of FIG. 5 after the bow springs 30 have been collapsed using a collapsing tool (not shown in FIG. 6) to lie generally along a portion of the length of the pipe string 80 on which the centralizer 8 is received. The bow springs 30 may be collapsed and restrained in the collapsed position shown in FIG. 6 using one of several tools known in the art. One example of such a collapsing tool is illustrated in FIGS. 9A-9C of U.S. Ser. No. 11/828,943 and described in the portions of the specification that relate to this same drawings. Each fin 32 is shown in FIG. 6 to be spot welded to an adjacent fin 32 to form a pair of generally parallel sacrificial restraining bands 39. Upon removal of the collapsing tool, the restraining bands 39 are each placed in tension and overcome the restoring forces of each of the bow springs 30 to restrain the bow springs 30 in their collapsed configuration so that the pipe string 80 and the centralizer 8 may be installed in the targeted interval of the borehole through a restriction, e.g., the bore of a previously installed pipe string. The centralizer 8 shown in FIG. 6 may be deployed by expansion of the pipe string 80 (and the centralizer 8) from its original diameter D1 to an expanded diameter D2. Expansion of the centralizer 8 causes the spot welds 33 to sacrificially fail, thereby allowing the bow springs 30 to deploy within the targeted interval of the borehole to center the pipe string 80 within the borehole. It should be understood that the spot welds 33 used to couple adjacent fins 32 to form the restraining bands 39 may be made sufficient to restrain the bow springs 30 in the fully collapsed configuration, but may also be small enough to ensure sacrificial failure of the spot welds 33 with unwanted deformation of a bow spring 30 to which the fin 32 may be connected.

It should be understood that the fins 32 may be connected to the radially inwardly disposed surface of the bow springs to protrude generally circumferentially toward fins connected to the radially inwardly disposed surface of adjacent bow springs or, optionally, the fins may be connected to protrude from the side of the bow spring toward fins connected to the sides of adjacent bow springs. While the fins may also be connected to the radially outwardly disposed side of the bow springs, the previously discussed methods abate the hanging of the fins on obstructions during installation of the pipe string.

It should further be understood that forming the restraining band as described above may enable the installation of longer pipe strings, larger diameter pipe strings, or both, due to the minimization of the outer diameter of the collapsed centralizer at the bow springs. The diameter of the expandable collars to which the bow springs are connected at the ends does not prevent the formation of a restraining band having a diameter that is smaller than the outer diameter of the expandable collars. It should be further understood that forming of a restraining band as described above may minimize the starting and running forces for a pipe string that has end collars that expand by sliding movement, as described herein, or with conventional end collars that expand with plastic deformation.

Figure 7:
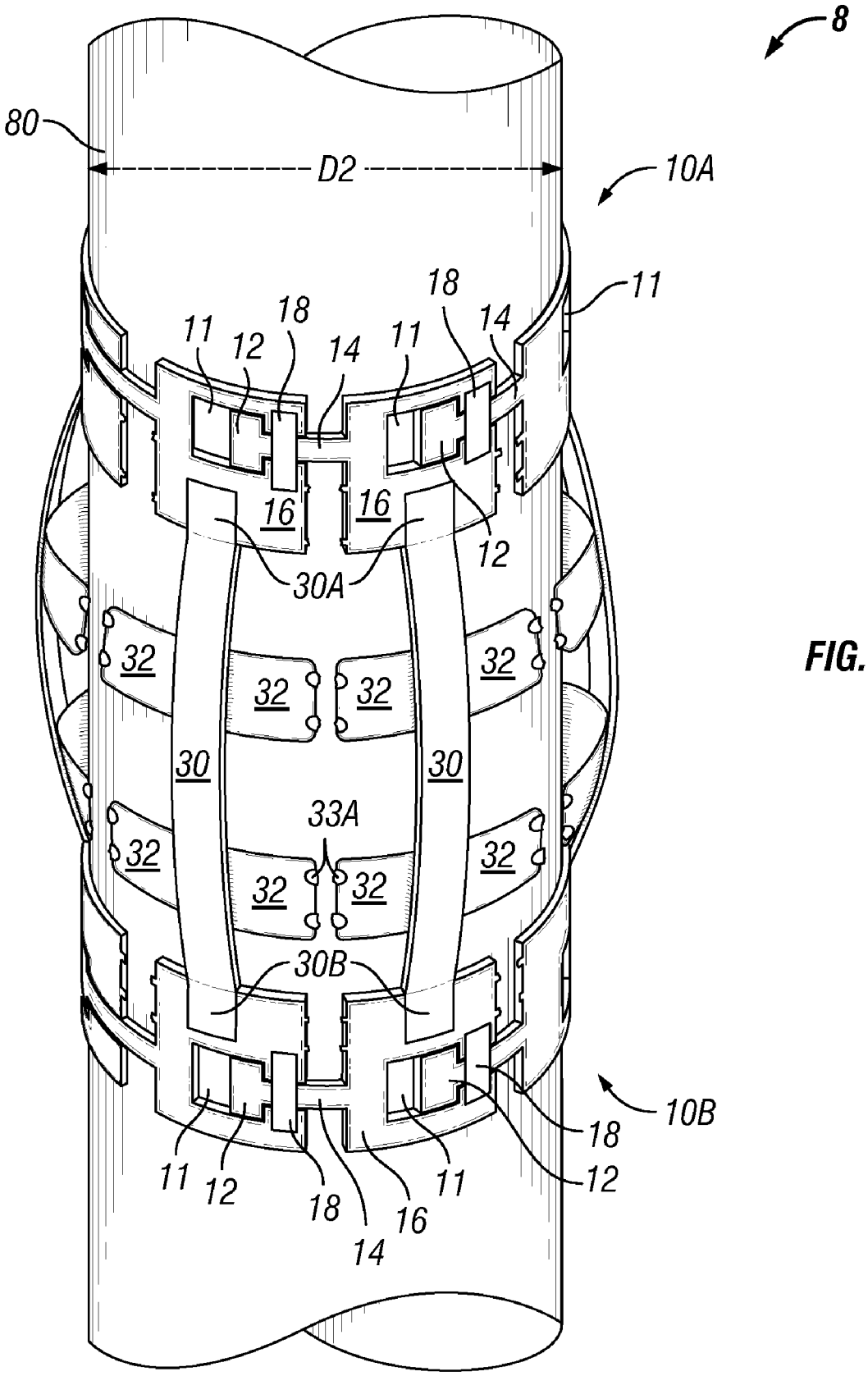
FIG. 7 is the perspective view of the close-tolerance expandable centralizer of FIG. 6 after the pipe string and the expandable centralizer have been expanded to rupture the restraining bands at the spot welds to release the bow springs to a deployed configuration.

FIG. 7 is the perspective view of the expandable centralizer of FIG. 6 after the pipe string 80 and the expandable centralizer 8 have been expanded to an expanded diameter D2 and the restraining bands 39 have been ruptured, e.g., by expansion to release the bow springs 30 back to their deployed configuration. FIG. 7 shows the fins 32 that were joined to form the restraining bands 39 shown in FIG. 6 generally back to their original form except for small failed spot welds 33*a* on the fins 32 where the sacrificial spot welds 33 were placed as shown in FIG. 6.

In one embodiment, the fins 32 may perform additional functions other than to secure the bow springs in the collapsed position. For example, the fins 32 may be positioned on the bow springs 30 to cause turbulence and/or mixing of drilling fluid or cement slurry that may be circulated through the annulus between the exterior of the expanded pipe string 80 on which the expandable centralizer 8 is received and the borehole (not shown in FIG. 7) when the expandable centralizer 8 is deployed in the borehole to center the expanded pipe string 80. This positioning of the fins may require that the fins be positioned between the apex or top of the arc of the bow spring that is generally at its center, and the end of the bow spring that connects to the collar. More specifically, this may require that the fins be positioned on the bow spring at or near the portion of the bow spring with relatively little curvature when the bow spring is in its deployed configuration.

Figure 8:
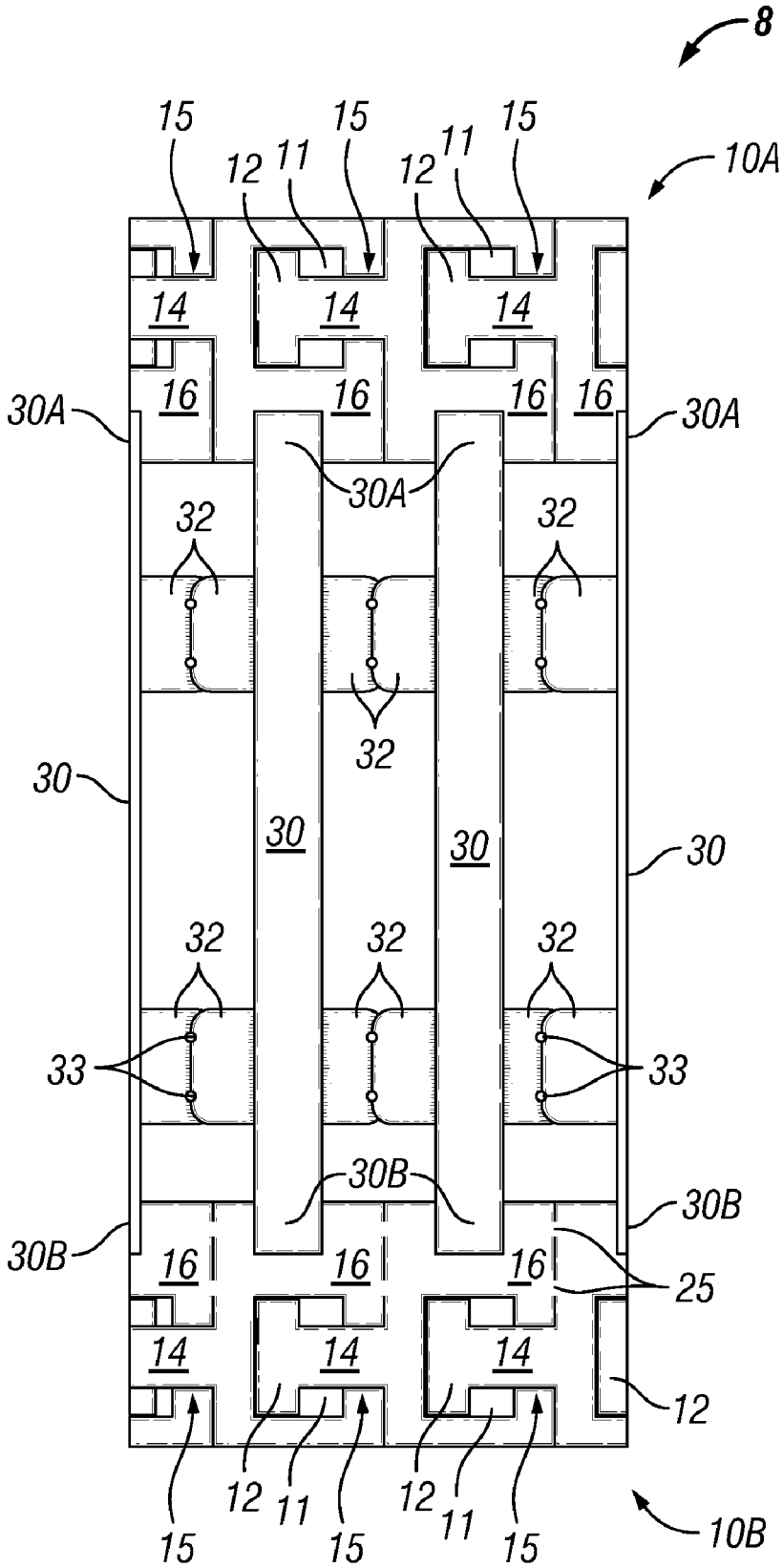
FIG. 8 is an elevation view of the close-tolerance expandable centralizer of FIG. 6 showing the configurations of the expandable collars and the positions of the sacrificial restraining bands relative to the expandable collars prior to expansion of the pipe string and deployment of the expandable centralizer to center the pipe string.

FIG. 8 is an elevation view of the expandable centralizer 8 that is shown positioned on the pipe string 80 in FIG. 6 with the bow springs in the collapsed configuration. FIG. 8 shows the configurations of the links 16, heads 12, extensions 14, chambers 11, channels 15 and bridges 25 of the expandable collars 10A, 10B, and the positions of the restraining bands 39 that secure the bow springs in their collapsed configuration relative to the expandable collars 10A, 10B prior to expansion of the pipe string and deployment of the expandable centralizer to center the pipe string.

It should be understood that the expandable centralizer of the present invention is not limited to any particular number of bow springs, or to any particular method of connecting the bow springs to the expandable collars, and that the embodiment shown in the appended drawings is an exemplary embodiment. Similarly, the placement of the fins (that may be connected to form one or more restraining bands) in locations other than the locations shown in the appended drawings is within the scope of the present invention.

It should further be understood that the appended drawings represent an idealized deployment of the bow springs of the expandable centralizer of the present invention, and that various factors could result in the stand-off provided by some deployed bow springs on one side of the expandable centralizer being less than the stand-off provided by other deployed bow springs on the other side of the expandable centralizer. For example, if the expandable pipe string on which the expandable centralizer of the present invention is secured may be installed in a targeted interval of the borehole that is non-vertical, then gravity may cause the bow springs on one side to provide less stand-off than is provided by the bow springs on the other side of the expanded centralizer.

It should be understood that, although the appended drawings depict embodiments in which each link is slidably coupled to two adjacent links in each of the expandable collars, an alternate embodiment of the expandable centralizer may comprise one or more links coupled to one or more adjacent links by a coupling that is not slidable, or by a coupling that is not movable. It should be understood that the advantageous expansion of the expandable collar without excessive plastic deformation at the collar/bow spring connections may be achieved with some links having static or otherwise non-slidable couplings.

It should be further understood that, although the appended drawings depict embodiments in which each expandable collar link is coupled to one and only one bow spring end, an alternate embodiment of the expandable centralizer may comprise one or more links that is coupled to two or more bow springs or not coupled to any bow spring.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. The terms "at least one" and "one or more" are used interchangeably. The term "pair," as used in the claims and specification, means two of an article, and does not imply that the two articles are identical.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. An expandable bow spring centralizer comprising:

a plurality of bow springs, each having a first end and a second end;

a first expandable collar comprising a bore and a plurality of links, the first expandable collar connected to the plurality of bow springs at the first ends, and at least one link coupled to at least one adjacent link and slidable between a retracted configuration and a separated configuration; and a second expandable collar comprising a bore and a plurality of links, the second expandable collar connected to the plurality of bow springs at the second ends, and at least one link coupled to at least one adjacent link and slidable between a retracted configuration and a separated configuration.

2. The expandable bow spring centralizer of claim 1 wherein a pair of adjacent slidably coupled links of the first and the second expandable collars is slidable between a retracted configuration and a separated configuration.

3. The expandable bow spring centralizer of claim 2 wherein the first and the second expandable collars are of a first diameter when a pair of adjacent links is in a retracted configuration, and the first and the second expandable collars are deployed to a second, expanded diameter when the pair of adjacent links is in an extended configuration.

4. The expandable bow spring centralizer of claim 1 wherein the first or the second expandable collars comprise one or more sacrificial bridges of material connecting adjacent links.

5. The expandable bow spring centralizer of claim 1 wherein the collar and bow spring connections comprise one or more sacrificial welded connections.

6. An expandable bow spring centralizer comprising:

a first expandable collar comprising a plurality of links, a first link being slidably coupled to a second link;

a second expandable collar, comprising a plurality of links, a first link being slidably coupled to a second link; and wherein the first expandable collar and the second expandable collar are coupled one to the other through at least one bow spring collapsible to a collapsed configuration;

wherein upon expansion of the bow spring centralizer the first links slidably move between a retracted configuration and a separated configuration.

7. The expandable bow spring centralizer of claim 6 wherein at least one link of the first expandable collar is connected to the first end of a bow spring and at least one link of the second expandable collar is connected to the second end of the bow spring.

8. The expandable bow spring centralizer of claim 6 wherein one or more bow springs have fins thereon, and wherein two or more bow springs are releasably connected one to the other through one or more of the fins when the bow springs are in the collapsed configuration.

9. The expandable bow spring centralizer of claim 8 wherein the sacrificial connection comprises one or more fins connected by welding.

10. The expandable bow spring centralizer of claim 9 wherein the fins are connected by welds.

11. An expandable bow spring centralizer comprising:

a first collar having a bore and a second collar having a bore;

a plurality of bow springs having a first end coupled to the first collar and a second end coupled to the second collar, and collapsible from a deployed configuration to a collapsed configuration; and one or more fins on one or more bow springs; and wherein at least one fin is connected upon collapse of the bow springs to an adjacent bow spring to form a restraining band.

12. The expandable bow spring centralizer of claim 11 comprising adhesively connected fins.

13. The expandable bow spring centralizer of claim 11 comprising deformable fins that are connected to form a sacrificial coupling that will fail upon expansion of a tubular on which the centralizer is received.

14. The expandable bow spring centralizer of claim 11 wherein the fins are metal and the fins are connected by a weld to form the restraining band.

15. The expandable bow spring centralizer of claim 11 wherein the fins are connected to at least one bow spring in a pair so that one fin of the pair protrudes from the bow spring in a direction opposite from the other fin of the pair.

16. The expandable bow spring centralizer of claim 11 wherein at least two pairs of fins are connected to at least one bow spring.

17. The expandable bow spring centralizer of claim 11 further comprising:

at least one fin that protrudes in a single direction from at least one of the bow springs.

18. The expandable bow spring centralizer of claim 17 further comprising:

at least one of the bow springs having fins protruding in two, generally opposite directions.

19. The centralizer of claim 11 wherein a fin is connected upon collapse of the bow springs to a fin protruding from an adjacent bow spring to form a bow spring restraining band.

20. A method of centering a pipe string within borehole comprising the steps of:

disposing a centralizer on a pipe string, the centralizer comprising a plurality of bow springs;

providing fins on at least a first bow spring and a second bow spring;

collapsing the first bow spring and the second bow spring;

connecting at least one fin on the first bow spring to at least one fin on the second bow spring to form a restraining band; and expanding the pipe string and the centralizer to cause the restraining band to sacrificially fail.

21. A method to make an expandable centralizer collar from a first tubular sleeve comprising the steps of:

cutting the first tubular sleeve into a first plurality of interlocking extendable links; and connecting an end of a plurality of bow springs to at least some of the first plurality of interlocking extendable links;

wherein a first extendable link is slidably movable between a retracted configuration and a separated configuration.

22. The method of claim 21 further comprising the steps of:

cutting a second tubular sleeve into a second plurality of interlocking extendable links; and connecting an opposing end of the plurality of bow springs to at least some of the second plurality of interlocking links.

23. The method of claim 22 further comprising the steps of:

connecting each of the plurality of bow springs, each having a first end and a second end, to an extendable link of the first expandable collar at the first end of the bow spring; and connecting each of the plurality of bow springs to an expandable link of the second expandable collar at the second end of the bow spring.

24. The method of claim 21 wherein the connecting step comprises welding.

25. The method of claim 21 wherein the connecting step comprises fastening.

26. A method of forming a first band to restrain a plurality of bow springs of a bow spring centralizer in a collapsed position comprising the steps of:

providing a first fin connected to a first bow spring of the bow spring centralizer;

receiving the bow spring centralizer on a pipe string;

collapsing the plurality of bow springs to the collapsed position; and connecting the first fin to at least one of a second bow spring or a second fin to form the first restraining band.

27. The method of claim 26 further comprising the step of connecting the plurality of first fins by welding the first fins to form the first band to restrain the bow springs in the collapsed position.

28. The method of claim 26 further comprising the step of connecting the first fins with a bonding agent to form the first band.

29. The method of claim 26 further comprising the steps of:

connecting a plurality of second fins to the plurality of bow springs; and connecting the plurality of second fins to form a second band in the collapsed configuration.

30. The method of claim 26 further comprising the step of:

expanding the expandable bow spring centralizer to rupture the first band and release each bow spring from the collapsed position to a deployed position.

31. An expandable centralizer comprising at least one expandable centralizer collar coupled to a plurality of bow springs, wherein the at least one expandable centralizer collar comprises a bore and at least one slidably intercoupled link;

wherein upon expansion of the expandable centralizer the at least one slidably intercoupled link moves from a retracted configuration to a separated configuration.

32. The expandable centralizer collar of claim 31 wherein the slidably intercoupled links expand from a retracted configuration about to at least one expanded configuration to enlarge the bore.

33. An expandable centralizer comprising:

a plurality of ribs having a first end and a second end;

a first expandable collar comprising a bore and a first slidably intercoupled link, wherein the first expandable collar is connected to at least one of the plurality of ribs at the first end; and a second expandable collar comprising a bore and a second slidably intercoupled link, wherein the second expandable collar is connected to at least one of the plurality of ribs at the second end.

34. A method of centering a pipe string within a borehole comprising the steps of:

providing a plurality of ribs coupled at a first end to a first collar having at least one slidably intercoupled link and coupled at a second end to a second collar having at least one slidably intercoupled link;

receiving the first and second collars on the pipe string;

running the pipe string into the borehole; and slidably extending the slidably intercoupled links of the first and second collars from a retracted configuration to an extended configuration to expand the first and second collars by expansion of an outer surface of the pipe string.

35. The method of claim 34 wherein the step of slidably extending the first and second slidably intercoupled links comprises the step of:

rupturing one or more sacrificial bridges retaining at least one of the first and second slidably intercoupled links in the retracted configuration.

36. The method of claim 35 further comprising the step of:

welding at least one of the first and second collar to provide a welded connection retaining the at least one of the first and second collar in the retracted configuration.

37. The method of claim 34 wherein the step of providing a plurality of ribs comprises providing a plurality of bow springs.

* * * * *